US006823619B2

(12) United States Patent
Monigle et al.

(10) Patent No.: US 6,823,619 B2
(45) Date of Patent: Nov. 30, 2004

(54) METHOD AND APPARATUS FOR SUSPENDING A PLURALITY OF SIGNS

(75) Inventors: Kurt Monigle, Denver, CO (US); Charles A. Hahn, Littleton, CO (US); Thomas Wilson, Denver, CO (US)

(73) Assignee: Wizard Co., Inc., Las Vegas, NV (US)

( * ) Notice: Subject to any disclaimer, the term of this patent is extended or adjusted under 35 U.S.C. 154(b) by 194 days.

(21) Appl. No.: 09/848,044

(22) Filed: May 3, 2001

(65) Prior Publication Data

US 2002/0162259 A1 Nov. 7, 2002

(51) Int. Cl.[7] ..... G09F 17/00; G09F 7/18
(52) U.S. Cl. ..... 40/604; 40/606.12; 40/617
(58) Field of Search ..... 40/603, 604, 612, 40/617, 757, 606.12, 738

(56) References Cited

U.S. PATENT DOCUMENTS

| | | | | | |
|---|---|---|---|---|---|
| 580,682 | A | * | 4/1897 | Ferguson et al. | 40/617 |
| 808,447 | A | * | 12/1905 | Goetz | 40/617 |
| 831,973 | A | * | 9/1906 | Mudd | 40/617 X |
| 1,856,349 | A | | 5/1932 | Bigelow | |
| 2,364,419 | A | * | 12/1944 | Barnes | 256/58 |
| 2,902,786 | A | * | 9/1959 | Schneider | 40/617 |
| 3,508,741 | A | * | 4/1970 | Steenhoudt | 256/40 |
| 3,949,503 | A | | 4/1976 | Waress | |
| 4,406,519 | A | | 9/1983 | Shaw | |
| 4,408,408 | A | | 10/1983 | Eng | |
| 4,646,997 | A | | 3/1987 | Fadley | |
| 4,735,326 | A | | 4/1988 | Steiner | |
| 4,827,647 | A | | 5/1989 | Monroe | |
| 4,829,688 | A | | 5/1989 | Mouraret et al. | |
| 4,972,614 | A | | 11/1990 | Hector | |
| 5,167,199 | A | | 12/1992 | Rehbein | |
| 5,355,603 | A | * | 10/1994 | Luikkonen | 40/541 |
| 5,398,436 | A | | 3/1995 | Suzuki | |
| 5,471,774 | A | | 12/1995 | Hoyt et al. | |
| 5,471,775 | A | | 12/1995 | Hoyt et al. | |
| 5,522,165 | A | | 6/1996 | Molla | |
| 5,588,236 | A | | 12/1996 | Suzuki | |
| 5,664,354 | A | | 9/1997 | Daviau | |
| 5,732,494 | A | | 3/1998 | Davey | |
| 5,794,906 | A | | 8/1998 | Harris | |
| 5,839,705 | A | | 11/1998 | Lamotte | |
| 5,848,488 | A | | 12/1998 | Norwood | |
| 5,893,226 | A | | 4/1999 | Sophocleous | |
| 6,012,688 | A | | 1/2000 | Lamotte | |
| 6,257,418 | B1 | * | 7/2001 | Allen et al. | 40/617 X |

FOREIGN PATENT DOCUMENTS

| | | | | |
|---|---|---|---|---|
| CH | 389004 | * | 6/1965 | 40/603 |
| GB | 878550 | * | 10/1961 | 40/617 |

* cited by examiner

*Primary Examiner*—Brian K. Green
(74) *Attorney, Agent, or Firm*—Lerner, David, Littenberg, Krumholz & Mentlik, LLP

(57) ABSTRACT

A sign system is disclosed for use with a parking lot which includes a plurality of parking spaces. The sign system comprises at least first and second monuments, a plurality of signs, and at least first and second cable segments suspended between the first and second monuments in a spaced relationship to each other. Each of the plurality signs is disposed adjacent to and bearing indicia identifying a corresponding one of the plurality of parking spaces and is affixed to both of the first and second cable segments in a steadying relationship. The first monument includes first and second weights, each of which is coupled respectively to a corresponding one of the first and second cable segments, whereby tension is applied to each of the first and second cable segments.

25 Claims, 7 Drawing Sheets

METHOD AND APPARATUS FOR SUSPENDING A PLURALITY OF SIGNS

FIELD OF THE INVENTION

This invention relates to signs and support structures for suspending a plurality of signs. In one embodiment of this invention, this invention relates to suspending a plurality of signs which are disposed adjacent to corresponding spaces, which in one embodiment of this invention take the form of parking places of a parking lot.

BACKGROUND OF THE INVENTION

In an illustrative embodiment of a parking lot, there is a plurality of parking spaces. Each space may be filled with an automotive vehicle. More particular if the parking lot is used to receive rental vehicles, there is a need to identify each such parking place to facilitate a car renter to readily find the vehicle that the renter has selected. At check in, a renter selects a particular vehicle to rent and, in turn, is given an alpha numeric designation of a particular parking space where the selected vehicle may be found.

Using that designation, the vehicle renter searches the rental vehicle parking lot for the particular parking place where the selected vehicle is parked. As is known, signs are distributed throughout the rental parking lot. Each parking space is assigned a predetermined alphanumeric designation and that designation is placed on a sign that is mounted adjacent to its parking space.

In the past, a single post has been used for each sign. The sign is affixed to the top of the post, while the bottom end is inserted within an opening through the surface of the parking lot. It is desired to mount such signs at a sufficient height above the vehicles so that the vehicle does not block the renter's view and make his/her search for a particular parking space and vehicle more difficult. Further, the American Disability Act (ADA) requires that signs must be suspended at a minimum height of 6 feet, 8 inches.

There are at least two problems associated with such single post sign mounting. First, such posts, particularly those of sufficient height to be readily seen by a renter, are not particularly stable. Further such signs may be readily damaged by the rental vehicles as they are driven to or from its parking place or by cleaning equipment. In northern climates, normal snow removal is a hazard to such signs. Snow removal vehicles often strike and damage such posts. The posts are often mounted relatively close to each other, which makes it difficult to remove snow that accumulates between or close to the posts without damaging or knocking down the signs.

A further problem for signs arises from the presence of high winds, which may not only damage the signs but also the structure for supporting the signs. Strong winds typically induce periodic movements of a sign. Where more than one sign is suspended by the support, the movements of the individual signs may be added together and, unless these motions are restrained, may not only damage the individual signs but also their support structure. Where as taught by this invention a plurality of signs are suspended by at least one cable or cable segment, the wind can readily induce damaging sign movements. For example where a cable is suspended along a horizontal axis and at least one sign is suspended from such a cable, wind can cause the sign to rotate in opposite directions about its cable. If more than one sign is suspended about such a cable, the rotating motions of such signs will tend to add together. In such a sign support system, the cable is so associated with its sign or signs such that there is no restraining action on the sign(s) as they rotate back and forth the about the horizontal axis defined by the cable. The signs which are unrestrained may rotate in unison back and forth, their motions adding to each other and, potentially, causing damage to the signs, the cable and the cable supporting structure.

To meet the requirements of the ADA that signs must be mounted at a minimum height of 6 feet, 8 inches, the cables suspending such signs are suspended horizontally in accordance with this invention. The surfaces, over which the signs of this invention are suspended, are rarely if ever perfectly level. Therefore, care needs to be taken when suspending the cables so that the end points of the cables may be adjusted to ensure that the cables are horizontally mounted, even when the surface, e.g., a parking lot, is nether flat nor parallel to the cable that is suspended above such a sloping surface.

SUMMARY

Thus, it is an object of this invention to provide a sign display system that supports vehicle parking spaces at a relative high position with respect to the vehicle to ensure that the renter may read the signs and locate that parking space where his or her selected vehicle may be found.

It is a further object of this invention to suspend a plurality of such signs without cluttering the parking lot with sign posts or other sign support structure that would hinder the cleaning of and/or the removal of snow from the parking lot.

It is another object of this invention to maintain continuous tension on the cables that suspend the signs to accommodate for different cable expansion rates resulting from temperature changes and/or differential temperatures.

It is a still further object of this invention to maintain the sign height and to keep its position stable in high winds.

It is another object of this invention to suspend one or more cables between adjacent monuments such that the cable(s) are disposed horizontally and parallel to each other.

It is a still further object of this invention to suspend one or more signs in a new and novel manner such that wind and even strong wind will not damage the sign(s), the cables from which the signs are attached or the structures for suspending the cables.

It is another object of this invention to provide a new and novel method of laying a sign system over a given space, e.g., a parking lot, to ensure that the signs are suspended above a minimum height and that the cable(s) are suspended substantially horizontally.

In accordance with these and other objects, this invention comprises a sign system, which is adapted for use with a parking lot, and includes a plurality of parking spaces. Further, the sign system comprises at least first and second monuments, a plurality of signs, and at least first and second cable segments suspended between the first and second monuments in a spaced relationship to each other. Each of the plurality signs is disposed adjacent to and bearing indicia identifying a corresponding one of the plurality of parking spaces and is affixed to both of the first and second cable segments in a steadying relationship. The first monument includes first and second weights, each of which is coupled respectively to a corresponding one of the first and second cable segments, whereby tension is applied to each of the first and second cable segments.

In a further aspect of this invention, the second monument includes a third weight that is coupled to at least one of the first and second cable segments, and the first and second cable segments are connected together to form a single continuous cable. The third weight is coupled to the continuous cable, whereby tension is applied by the third weight to each of the first and second cable segments.

In a still further aspect of this invention, there is included first, second and third grooved rollers. The continuous cable extends from the first monument to and is suspended over the first roller, extends downward and suspends the second roller, and extends upward and over the third roller. There is included a first fixedly mounted arm for rotatively mounting the first roller, a second fixedly mounted arm for rotatively mounting the third roller, and a third arm for rotatively mounting the second roller and connected to the third weight, whereby the second roller is suspended by the continuous cable to move as said continuous cable is stretched to place tension on the continuous cable.

In a further aspect of this invention, the sign system comprises third and fourth cable segments, and a third monument spaced from the second monument. The third and fourth cable segments are suspended between the second and third monuments. The third monument includes third and fourth weights. Each of the third and fourth weights is coupled respectively to a corresponding one of the third and fourth cable segments, whereby tension is applied to each of first and second cable segments. The second monument includes a fifth weight that is coupled to at least one of the first and second cable segments, and a sixth weight that is coupled to at least one of the third and fourth cable segments. The first and second cable segments are connected together to form a first single continuous cable. The third and fourth cable segments are connected together to form a second continuous cable. The fifth weight is coupled to the first continuous cable, and the sixth weight is coupled to the second continuous cable.

In a still further aspect of this invention, the second monument includes first, second, third, fourth, fifth and sixth grooved rollers. The first continuous cable extends from the first monument to and is suspended over the first roller, extends downward and suspends the second roller and extends upward and over the third roller. The second continuous cable extends from the third monument to and is suspended over the fourth roller, extends downward and suspends the fifth roller and extends upward and over the sixth roller. The sign system further includes a first fixedly mounted arm for rotatively mounting the first roller, a third fixedly mounted arm for rotatively mounting said third roller, a fourth fixedly mounted arm for rotatively mounting the fourth roller, a sixth fixedly mounted arm for rotatively mounting the sixth roller, a second arm for rotatively mounting the second roller and connected to the fifth weight, and a fifth arm for rotatively mounting the fifth roller and connected to the sixth weight.

In another feature of this invention, there is included a guide affixed to each of said second and fifth arms so that the second and fifth rollers move in unison with each other. The second monument includes a support tube, and the guide engages the support tube to guide the travel of the fifth and sixth weights along the support tube.

In a still further aspect of this invention, each of the first and second cable segments includes first and second ends. The first ends are connected respectively to the first and second weights, and the second ends are affixed to the second monument. The sign system further includes third and fourth cable segments, and a third monument. The third and fourth cable segments are suspended between the second and third monuments. The third and fourth cable segments are affixed to the second monument.

In another aspect of this invention, at least one cable segment is suspended under tension along an axis, and a sign is suspended from the one cable segment. The sign has first and second edges oriented substantially perpendicular to the axis and is configured such that the wind primarily spills around the first and second edges, whereby the wind tends to rotate the sign about the axis and the one cable segment tends to constrain such rotational motion. Further, the sign comprises at least first and second opposing surfaces, and a second axis is substantially perpendicular to the first-mentioned axis. At least one of the first and second surfaces is curved about the second axis to impart a first curvature to the one surface.

BRIEF DESCRIPTION OF THE DRAWINGS

The nature, operation and advantages of this invention will be apparent to those skilled in the art when this document is read in conjunction with the attached drawings, where matching reference numbers are applied to matching elements and where.

DETAILED DESCRIPTION OF THE PREFERRED EMBODIMENTS

Figure 1A:
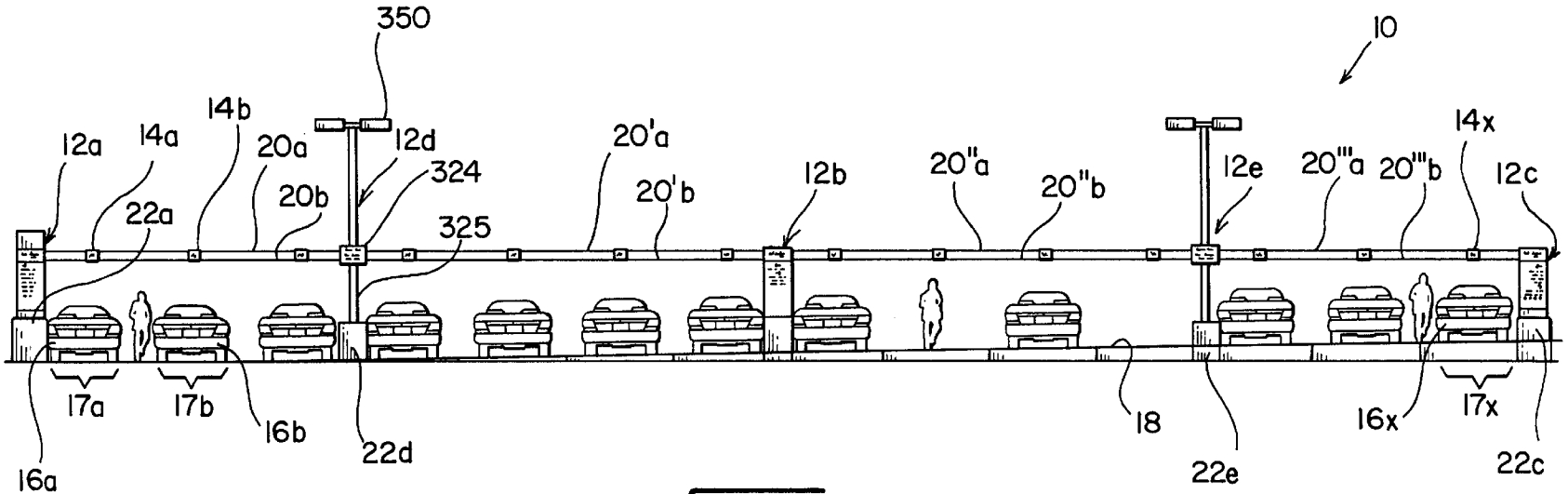
FIGS. 1A and B are respectively an elevational view of a sign system in accordance with the teachings of this invention, wherein a plurality of signs are attached to cables suspended between a first end monument, a plurality of center or intermediate monuments and a second end monument over an extended area, e.g., a parking lot in one illustrative embodiment of this invention, to identify by the use of appropriate indicia displayed by various of the signs related positions, e.g., parking places in the noted embodiment, within the area for the placement of related objects, e.g., vehicles, and a further embodiment of this sign system, wherein the monuments are arranged on a parking lot wherein the elevation varies sufficiently to require a different embodiment of the monument that will permit the cables to be horizontally suspended between adjacent monuments.

Referring now to the drawings and in particular to FIG. 1A, there is shown a sign suspension system 10, which is constructed and arranged to suspend a first pair of cables 20*a* and 20*b* in parallel relationship with each other and between a first end monument 12*a* and a second intermediate monument 12*d* and to suspend a second pair of cables 20'*a* and 20'*b* in parallel relationship with each other and between the second intermediate monument 12*d* and a third intermediate monument 12*b*. In turn, a third pair of cables 20"*a* and "*b* is suspended between the third intermediate monument 12*b* and a fourth intermediate monument 12*e*. Finally, a fourth pair of cables 20'''*a* and 20'''*b* is suspended between the fourth intermediate monument 12*e* and a second end monument 12*c*. In an illustrative embodiment of this invention, the cables or cable segments 20 may take the form of 3/16 inch type 304 non-magnetic stainless steel with a 7×19 strand core cable. As will be explained in greater detail below with respect to FIGS. 5A and B, each of the second and fourth intermediate monuments 12*d* and *e* serve to support light fixtures 350 from the top thereof. A plurality of signs 14*a* to 14*x* are hung from the first, second, third and fourth pairs of cable segments 20. In a contemplated use, the sign suspension system 10 may be used out of doors, where the system 10 and, in particular, its signs 14*a* to 14*x* will be exposed to the elements and, in particular, to the wind. To prevent the wind from rotating or otherwise moving the signs 14 and, thus, making it difficult for a user to see, much less read, the signs 14, they are suspended from a pair of cable segments 20 which are spaced from each other in a parallel relationship, whereby the signs 14 are held relatively steady to permit their ready reading.

In one illustrative embodiment of this invention, the sign suspension system 10 may be used in the context of a parking lot 18, which includes in one illustrative embodiment of this invention a plurality of parking places 17*a*, 17*b* - - - 17*x*. Each of the plurality of vehicles 16 is assigned to a corresponding one of the parking places 17. In turn, each of the plurality of signs 14*a*, 14*b* - - - 14*x* relates to and identifies a corresponding one of the parking places 17*a*, 17*c* - - - 17*x* by a corresponding indicia. Thus when the parking lot 18 is used to store rental vehicles 17, each vehicle renter is informed as to a particular parking place 17 where his or her vehicle 16 may be found by its indicia, e.g., "W99", which is displayed on the sign 14 as particularly shown in FIG. 6A. In particular, the indicia "W99" is placed on one of the plurality of signs 14*a*, 14*b* - - - 14*x*. In particular, a known vehicle 16 is parked in the parking space 17 that corresponds to the sign 14 bearing the indicia "W99". When a renter asks for that know type of vehicle 16, he or she is given the indicia "W99" to facilitate the renter's finding the vehicle 16 selected by the renter.

A significant benefit as shown in FIG. 1A is that this method and apparatus mount the signs 14 relatively high above the parking lot 18 to permit a user to see the signs 14 and their messages. In addition, since many signs 14 may be suspended above the parking lot 18 by the use of only a limited number of monuments 12, which occupy a small amount of the space of the parking lot 18 as shown in FIG. 1, it is a relatively easy matter to remove snow or otherwise clean the parking lot 18 without moving the monuments 12 that are needed to support the plurality of signs 14.

Figure 2B:
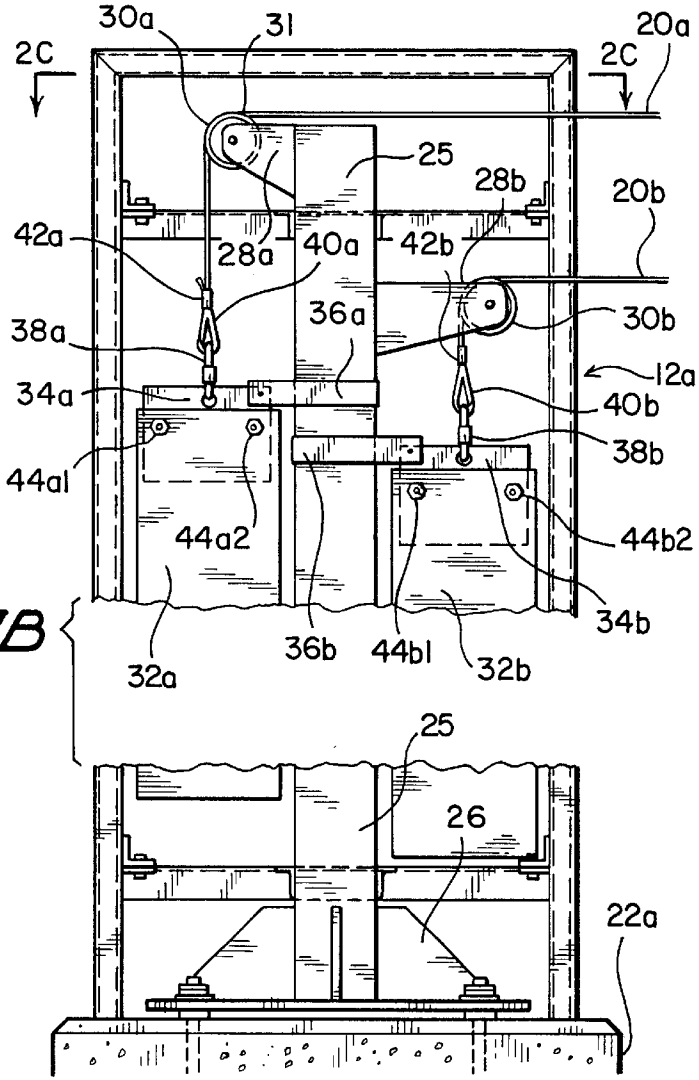
FIGS. 2A, B and C are respectively a front elevational view, a front elevational view sectioned along line 2B—2B of FIG. 2C, and a top view sectioned along line 2C—2C of FIG. 2B, of the first end monument for suspending the ends of the cables and disposed at an end of the sign system as shown in FIG. 1A.
Figure 2A:
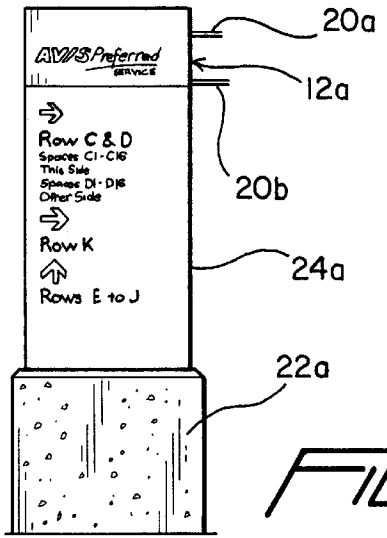

Referring now to FIGS. 2A, B and C, there is shown the first end monument 12*a* in greater detail. The end monument 12*a* comprises a foundation 22 which is constructed in one illustrative embodiment of concrete to provide a stable termination for a first pair of cables 20*a* and *b*. Illustratively, the force exerted by signs 14 and the cable segments 20 may be in the range of 400–1000 pounds; to stabilize such forces, the foundation 22*a* may weigh in the order of 3000 pounds. The end monument 12*a* also includes a pair of sign faces 24*a* (only one of which is illustrated in the drawings). As best shown in FIGS. 2B and C, the end monument 12*a* suspends one end of each of the cable segments 20*a* and 20*b* and, in particular, secures it to corresponding weights 32*a* and 32*b*, whereby the cable segments 20*a* and 20*b* are tensioned. Tensioning the cables 20 maintains and stabilizes the position of the signs 14, and compensates for stretching and damage to the cables 20.

The detailed structure of the end monument 12*a* will now be described with respect to FIGS. 2B and C. A support tube 25 is affixed to the foundation 22*a* by a base plate 26; in particular, a plurality of bolts are inserted through openings in the base plate 26 and the foundation 22*a* to affix the support tube 25 in a perpendicular orientation with respect to the top surface of the foundation 22*a*. As best shown in FIG. 2C, a cross section of the support tube 25 is of a square configuration A first pair of support arms 28*a* and a second pair of support arms 28*b* are affixed to opposite sides of the support tube 25 and extend in opposite directions with respect to each other. As best shown in FIG. 2B, the first pair of support arms 28*a* is disposed above the second pair of arms 28*b* to permit the suspension of the cable segments 20*a* and *b* by the end monument 12*a* in spaced relationship from each other, whereby the cable segments 20*a* and *b* will not touch or otherwise interfere with each other. Each pair of support arms 28*a* or *b* has an end which is affixed to one side of the support tube 25 in a suitable manner, e.g., welding. As best shown in FIG. 2C, each pair of support arms 28 are spaced from each other to receive therebetween and to rotationally mount a sleeve or roller 30. Each of the rollers 30*a* and *b* has a groove 31 about its periphery for receiving the cable segment 20*a*. In particular, the cable segment 20*a* is introduced through an opening in the end monument 12*a* to be received in the groove 31 of the roller 30*a*; the cable segment 20*a* hangs downward from its roller 30*a* as shown in FIG. 2B and its end is secured to a weight 32*a*, which is comprised of a plurality of weight plates 32*a*1, 32*a*2 - - - 32*a*6 as best shown in FIG. 2C. As best shown in FIG. 2B, the end of the cable segment 20*a* is formed into a loop to receive therein a compression sleeve 40*a*. The end is tightened about its sleeve 40*a* and is secured to the cable segment 20*a* by a gusset 42*a*. In turn, a fastening clip 38*a* is secured to the compression sleeve 40*a* and to the end of the cable segment 20*a* and to an opening within a hanging support 34*a*, as shown in FIG. 2B. As shown in both of FIGS. 2A and B, the hanging support 34*a* is affixed to the plurality of weight plates 32*a*1, 32*a*2 - - - 32*a*6 by a pair of the bolts 44*a*1 and 44*a*2, which extend through corresponding openings in the weight plates 32; the ends of the bolts are secured by nuts. As best shown in FIG. 2B, the weight 32*a* pulls the cable segment 20*a* downward and thereby maintains the cable segment 20*a* substantially parallel to the surface of the parking lot 18 as shown in FIG. 1. If the cable segment 20*a* stretches as may be expected in the course of use or by impact occurring in an accident, the cable segment 20*a* will rotate the roller 30*a* and will move the weight 32*a* downward. A tube guide 36*a* is disposed about the support tube 25 and, further, is attached to the hanging support 34*a*, whereby the travel of the weight 32*a* rectilinearly along the tube 25 is kept thereby in a straight path.

Similarly as shown best in and described above with respect to FIG. 2A, the cable segment 20*b* extends through an opening within the end monument 12*a*, passes over a roller 30*b*, and extends downwardly and is secured to a weight 34*b* by a compression sleeve 40*b*, a fastening clip 38*b*, a hanging support 34a and a fastening clip 38*b*. In addition, as the weight 34*b* pulls the cable segment 20*b* downward, the cable segment 20*b* rotates the roller 30*b* and a tube guide 36*b* slides downwardly along the support tube 25, thus guiding the movement of the weight 32*b*.

Though separate detailed drawings of the second end monument 12*c* are not provided other than the general showing of FIG. 1A, it is appreciated that the structure and operation of the end monument 12*c* are similar to that shown and described above with respect to FIGS. 2A, B and C.

Figure 3B:
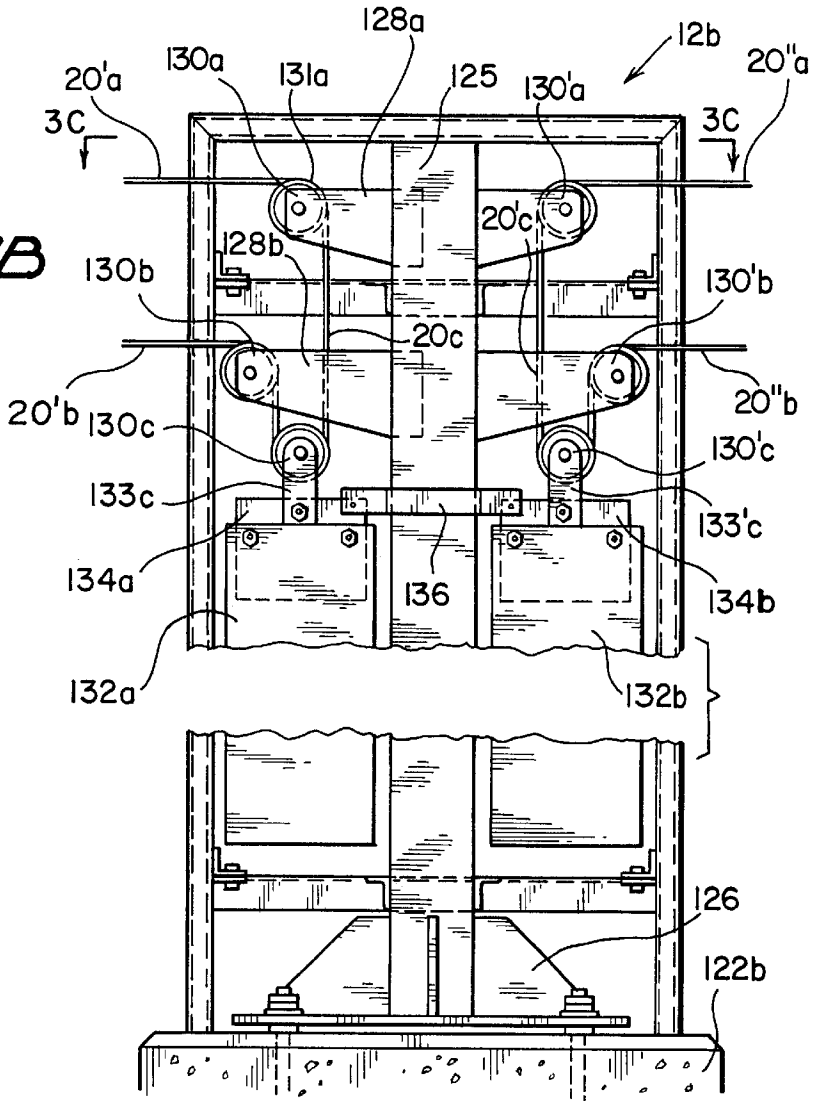
FIGS. 3A, B and C are respectively a front elevational view, a front elevational view sectioned along line 3B—3B of FIG. 3C, and a top view sectioned along line 3C—3C of FIG. 3B, of the second intermediate monument for suspending and tensioning the cables and disposed intermediate of or centrally of two end monuments of the sign system as shown in FIG. 1A.
Figure 3A:
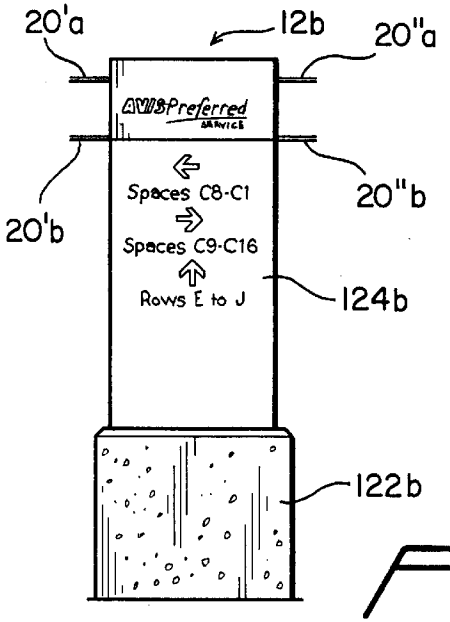
Figure 3C:
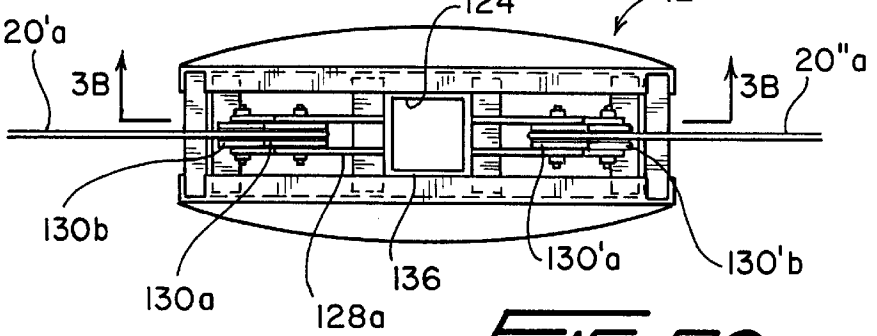

A detailed showing of one illustrative embodiment of the third intermediate monument 12*b* is shown in and is described with respect to FIGS. 3A, B and C. Referring to the embodiment shown in FIGS. 1A and 3B, it is appreciated that the pair of cables segments 20'*a* and 20'*b* which extend between the second intermediate monument 12*d* and the third intermediate monument 12*b* is a single, continuous cable 20. Likewise the cable segments 20"*a* and 20"*b* extending between the third intermediate monument 12*b* and the fourth intermediate monument 12*e* may also be a single cable 20. Appreciating the similarity in structure of the first end monument 12*a* and the third intermediate monument 12*b*, the elements of the third intermediate monument 12*b* are identified by like numerals except in the 100s series. Referring now to FIGS. 3B and C, the third intermediate monument 12*b* comprises a foundation 122*b*, upon which is mounted a support tube 125 in a perpendicular orientation to the foundation 122*b*. A first pair of support arms 128*a* is affixed at a first upper position of the support tube 125, and a second pair of support arms 128*b* is affixed at a second position of the support tube 125 that is lower than the first upper position. A first roller 130*a* is rotatively mounted between the first pair of support arms 128*a*, and a second roller 130*b* is rotatively mounted between the second pair of support arms 128*b*. The first segment 128*a* of the continuous cable 128*a* is brought to and disposed in a groove 131*a* of the roller 130*a*, is directed downward about a groove 131*c* within a third roller 130*c*, is directed upward and disposed about a groove 131*b* in the second roller 130*b*, before being directed to the first end monument 12*a* as shown in FIG. 1A. The third roller 130*c* is rotatively mounted on one end of a bracket 133*c*. The second end of the bracket 133*c* is affixed to a hanging support 134*a*, which as described above serves to assemble a plurality of weight plates to form a first weight 132*a*. In the embodiment of the third intermediate monument 12*b* as shown in FIGS. 3B and C, the weight 132*a* exerts a force on the continuous cable 20' that includes the segments 20'*a* and 20'*b*. In this embodiment, the continuous cable 20' has first and second ends to which forces are applied by the weights 32*a* and 32*b* respectively. As explained above with respect to FIGS. 2A, B and C, the first and second segments 20'*a* and '*b* are suspended between the second intermediate monument 12*d* and the third intermediate monument 12*b*, and a bite 20*c* interconnects the first segment 20'*a* and the second segment 20'*b*. The weight 132*a* applies as shown and explained above with respect to FIG. 3B a force to the bite segment 20*c*, whereby the segments 20'*a* and 20'*b* are tensioned and are suspended between the monuments 12*d* and 12*b* at a maximum, stable height, even if the cable 20' stretches or is otherwise damaged.

Similarly, the continuous cable 20" has a pair of cable segments 20"*a* and 20"*b* that are suspended between the third intermediate monument 12*b* and the fourth intermediate monument 12*e*, first and second ends which are attached to weights that are mounted in the fourth intermediate monument 12*e* in a manner similar to that shown in FIGS. 2B and C, and a bite segment 20"*c* to which a force is applied to by the weight 132*b* in a manner shown and described above with respect to FIG. 3B. The suspended cable segment 20"*a* is directed through an opening in the third intermediate monument 12*b* and wrapped about a first roller 130'*a* that is supported by a support arm 130*b*, is directed downward, is wrapped about a third roller 130'*c*, is wrapped about a second roller 130*b*, before the second segment 20"*b* is suspended between the third intermediate monument 12*b* and the fourth intermediate monument 12*e*. The third roller 130*c* is rotatively mounted on a first end of a bracket 131'*c*; the second end of the bracket 131'*c* is attached to a weight 132*b* by a support frame 134*b*, whereby the force of the weight 132*b* is exerted on the bite 20"*c* and the cable segment 20"*b* is tensioned.

Figure 4B:
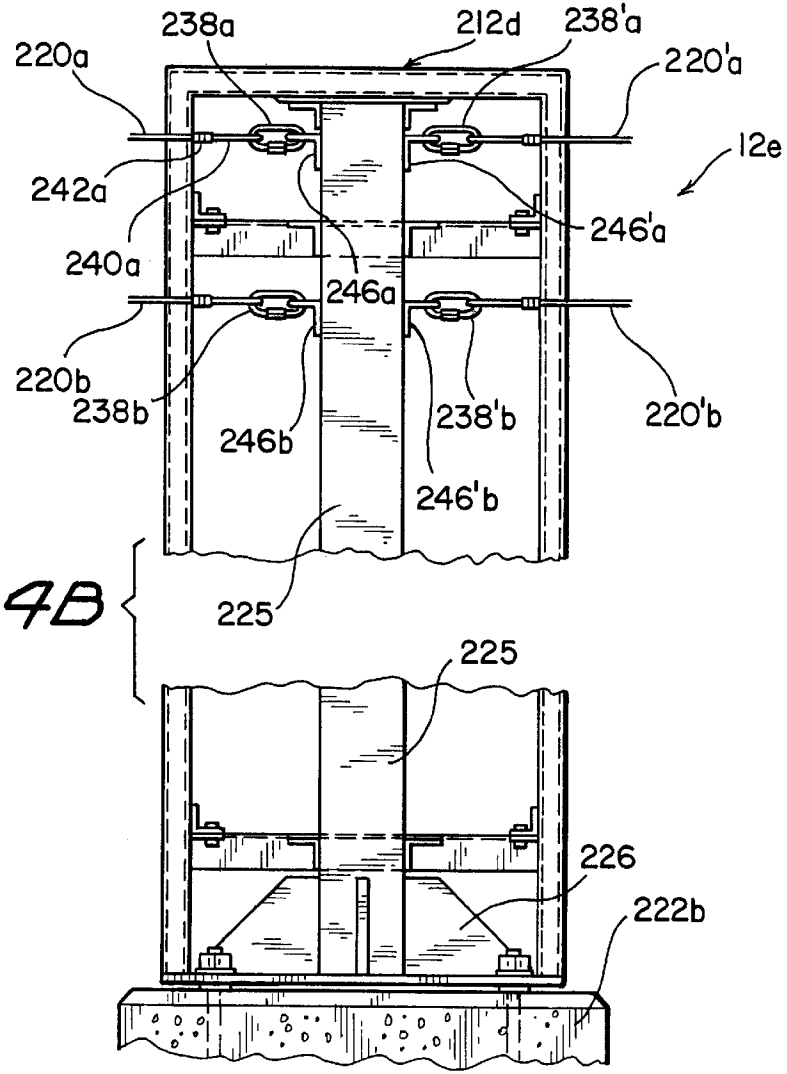
FIGS. 4A, B and C are respectively a front elevational view a front elevational view of a further alternative embodiment of the second intermediate monument for suspending the ends of the cables and disposed intermediate of or centrally of the two end monuments of the sign system as shown in FIG. 1A.
Figure 4A:
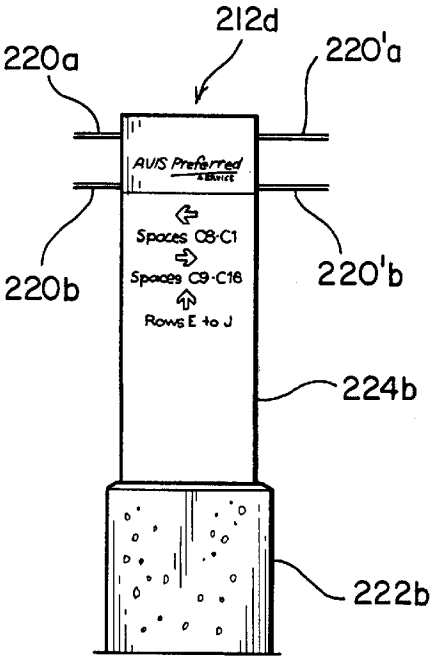

Referring now to FIGS. 4A, B and C, there is shown a first embodiment of the second intermediate monument 212*d*, where elements similar to those of the first end monument 12*a* are identified by the like first two digits but in the 200s series. In this illustrative embodiment, the cable 200 is not a single cable, but rather is separated into two parts or cable segments 220*a* and 220*b*. The first segment 220*a* has a first end that may be connected to the first end monument 12*a* in a manner to apply the force of the weight 32*a* to that first end as shown in and explained above with respect to FIG. 2A. The second end of the first cable segment 220*a* is connected directly to the first embodiment of the second intermediate monument 212*d* and, in particular, to a support tube 225. A first L-shaped bracket 246*a* is affixed to the support tube 225 at a first upper position, while a second L-shaped bracket 246*b* is affixed to the support tube 225 at a second position lower than the first position. The end of the first cable segment 220*a* is looped about a first compression sleeve 242*a* in a manner similar to that explained above with respect FIG. 2B. A fastening clip 238*a* is clipped through the compression sleeve 242*a* and through an opening (not shown) in the bracket 246*a*, whereby the end of the first cable strand 220*a* is affixed to the support tube 225. In like fashion, the end of the second cable segment 220*b* is also connected via a fastening clip 238*b* to a second bracket 246*b*, which is in turn affixed to the support tube 225. In this embodiment, tension is only applied to first ends of the cable segments 220*a* and 220*b* by respective weights 32*a* and 32*b* as shown and explained above with respect to FIG. 2B.

In like fashion, the pair of cable segments 220'*a* and 220'*b*, which may be suspended between the third intermediate monument 12*b*, as shown in FIG. 1A and the first embodiment of the second intermediate monument 212*b*, as shown in FIGS. 4A, B and C. In particular, the end of the first cable segment 220'*a* is coupled by a first fastening clip 238'*a* to an L-shaped bracket 246'*a*. In turn, the bracket 246'*a* is affixed to a surface of the tube support 225, which is on the opposite side of the tube support 225 from that surface on which the brackets 246*a* and *b* are affixed. Likewise, the end of the second cable segment 220'*b* is coupled by a second fastening clip 238'*b* to a bracket 246'*b*, which is in turn affixed to the tube support 225.

Figure 5A:
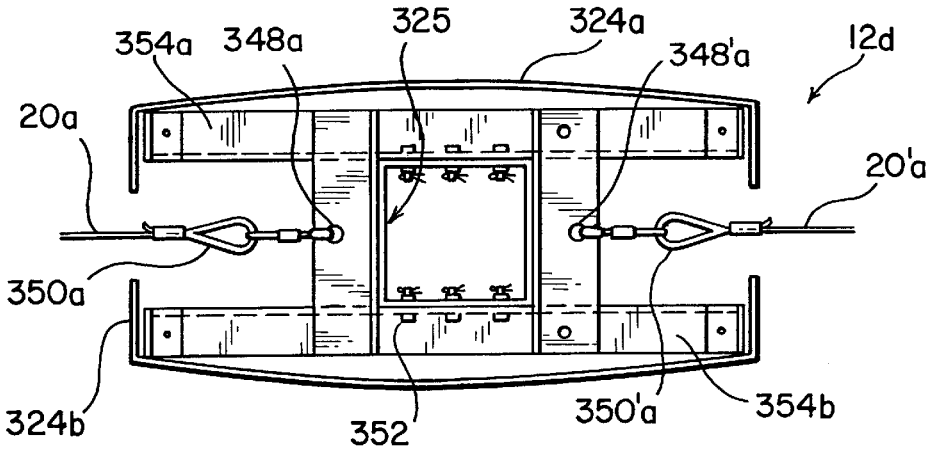
FIGS. 5A and B are respectively a top plan view of a support tube for supporting a housing, brackets for attaching cables to the tube and a light fixture as shown in FIG. 1A, and a front elevational view taken as a cross section of FIG. 5A.

Referring now to FIGS. 5A and B, there is shown the second intermediate monument 12*d*, which is a second embodiment of the second intermediate monument 212*b* and serves to support the lighting fixture 350 as shown in FIG. 1A. A fourth intermediate monument 12*e*, as shown in FIG. 1A, is constructed similarly to that of the first embodiment of the second intermediate monument 12*d*, as shown in FIGS. 4A, B and C. The monument 12*d* includes a foundation 22*d* (see FIG. 1A) that is similar to the foundation 222*b* as shown in FIGS. 4A and B and supports a bottom end of a support tube 325. In turn, the top end of the support tube 325 is affixed to and supports the lighting fixture 350.

Similar to the monument 212*d* of FIG. 4B, the monument 12*d* includes a first pair of L-shaped brackets 346*a* and 346'*a* that are affixed at a first position on the support tube 325, and a second pair of L-shaped brackets 346*b* and 346'*b* that are affixed to the support tube 325 at a second position beneath the first position. A first pair of cables 20*a* and *b* is connected to the brackets 436*a* and *b* by the use of fastening clips 338*a* and *b*. In particular, the clips 338*a* and 338'*a* are connected to the openings 348*a* and 348'*a* through the L-shaped brackets. A second pair or cables 20'*a* and '*b* is similarly connected to the post 325. Further, a pair of support brackets 354*a* and *b* is affixed to the ends of the L-shaped brackets 346*a* and 346'*a*. A similar set of support brackets (not shown) are similarly connected to the L-shaped brackets 346*b* and 346'*b*. Both sets of support brackets 354 serve to support a pair of rectangularly shaped housings 324*a* and *b*; the ends of the housings 324*a* and *b* are spaced a part to permit the cables 20 to pass through the openings between the housings 324*a* and *b*.

Figures 6A, 6B, 6C:
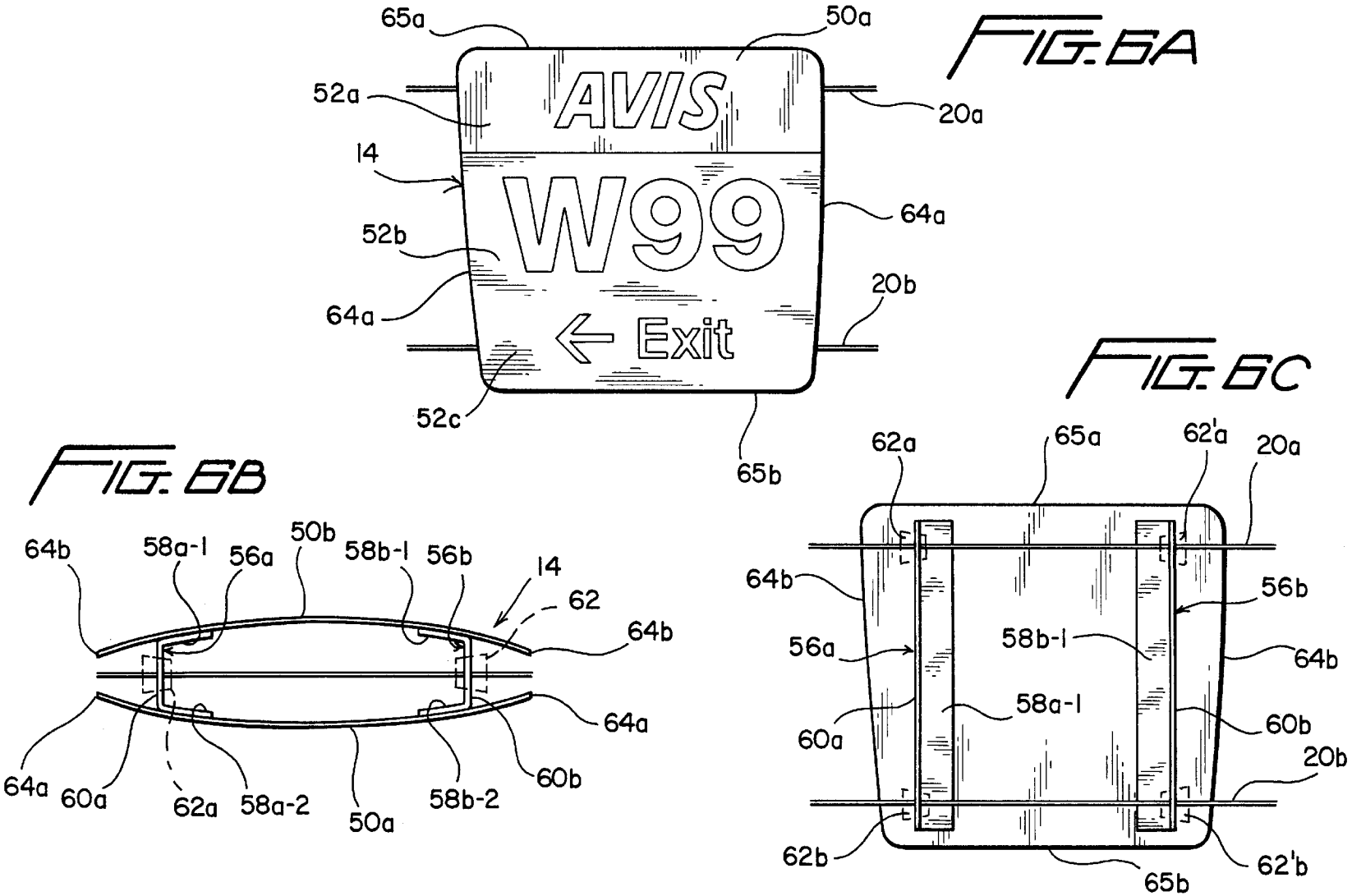
FIGS. 6A, B and C are respectively a front elevational view, a top view and an elevational view section along line 5C—5C of FIG. 5B, of a sign to be suspended by the sign system of this invention, as shown in FIG. 1A.

Referring now to FIGS. 6A, B and C, there is shown the detailed structure of the plurality of signs 14. In an illustrative embodiment of the sign 14, there is included first and second sign faces 50*a* and *b*. It is appreciated that the same or different messages may be second sign faces 50*a* and *b*. It is appreciated that the same or different message may be displayed on the first and second sign faces 50*a* and *b*. As shown in FIG. 6A, the sign face 50*a* includes a plurality of display areas 52*a, b* and *c*, each in this illustrative embodiment bearing different indicia, i.e., different messages. For example, the first display area 50*a* identifies the name of the rental car company, i.e., "Avis", the second display area 50*b* identifies which one of the plurality of parking places 17*a*, 17*b* - - - 17*x* that that this particular sign 14 relates to, e.g., this sign 14 relates to the "W99" parking place 17 and the particular vehicle 16 that has been parked in the identified space 17. In this fashion, the vehicle renter is informed of the "W99" space 17, which will direct the renter to that location or space 17 where the particular vehicle 16 that has been assigned to this renter has been parked. The third area 52*c* provides directions to the nearest exit.

In particular, the first and second sign faces 50*a* and *b* are spaced apart by a pair of spacing brackets 56*a* and *b*, which are disposed between the sign faces 50*a* and *b*, and at either end of the sign 14 as shown in FIGS. 6B and C. Each of the brackets 56*a* and 56*b* is U-shaped and includes a first leg portion 58*a*-1 (or 58*b*-1), a second leg portion 58*a*-2 (or 58*b*-2) and a bite or support member 60*a* (or 60*b*). As shown in FIGS. 6B and C, each of the first leg portions 58*a*-1 and 58*b*-1 is affixed to the inside surface of the sign face 50*b* as shown in FIGS. 6B and C, while each of the second leg portions 58*a*-2 and 58*b*-2 is affixed to the inside surface of the sign face 50*a* as shown in FIG. 6B. As best shown in FIG. 6C, a pair of first cable hold stoppers 62*a* and *b* is mounted within openings disposed through the first support bracket 60*a* and spaced from each other. Similarly, a further pair of second cable hold stoppers 62'*a* and 62'*b* is mounted within openings disposed through the second support bracket 60*b*. Illustratively, the stoppers 62 are made of rubber, which increases the friction between the cables 20 and the stoppers 62, whereby the cables 20 are more tightly held within the spacing brackets 56*a* and *b*.

The configuration of the sign faces or surfaces 50*a* and 50*b*, as shown in FIGS. 6A, B and C, is shaped to cause the wind to spill off of the vertical edges 64*a* and *b* of the sign faces 50*a* and 50*b*, respectively. In particular, the sign faces 50*a* and 50*b* are curved whereby the distance between the adjacent edges 64*a* and *b* is less than the distance between the center portions of the sign faces 50*a* and 50*b*. By so controlling the wind movement about the sign faces 50*a* and 50*b*, they tend to be rotated successively in one direction and then in another direction about a vertical axis whereby the tensions applied to the parallel cables 20*a* and 20*b* is effective to limit and to dampen such motion. Further, the rotation about the vertical axis of adjacent signs 14 or even a larger number of signs 14 tends to dampen the motion of its signs 14 suspended on a common pair of cables 20. As a result, the positions of the signs 14 remain stable, even in high winds, whereby the information born by such signs 14 remains visible. On the other hand if the sign faces 50 were configured to spill the wind about the top and bottom edges 65*a* and *b* of the sign faces 50, the sign 14 would tend to rotate about a horizontal axis. In contrast, the horizontally suspended cables 20 do not effectively oppose rotation of the signs 14 about their horizontal axes. In addition, such rotation of commonly suspended signs 14 can potentially reinforce each other causing successively greater movements of the signs 14 and possible damage to signs 14, the cables 20 and even the cable supporting structure. Further if the sign faces 50 were flat, the wind would tend to randomly spill over the top, bottom and sides edges, whereby rotation would be induced randomly about both vertical and horizontal axes and such a sign would be difficult to read.

Referring now to FIGS. 1A and B, there is shown the sign system 10, which includes the plurality of monuments 12*a-e* laid out over a surface, e.g., the parking lot 18. As shown, the parking lots 18 are not flat, but rather their surfaces slope. In FIG. 1A, the parking lot 18 slopes downward from right to left, i.e., from monument 12*c* to monument 12*a*, whereas in FIG. 1B, the parking lot 18 slopes from right to left, i.e., from monument 12*b* to monument 12*a* upwardly. There will now be described briefly a method of laying out and constructing the monuments 20 to ensure that the cable segments 20 will be suspended along a horizontal axis and that the height of the suspended cable 20 is kept above the minimum requirement. Initially, the first step determines the number of monuments 12 that can be laid out over the parking lot 18. In an illustrative embodiment of this invention as shown in FIG. 1A, each auto stall 17 may have a width of 9–10 feet, whereas the monuments 12 may be spaced from each other a maximum of 5 to 6 auto stalls 17, or 45–60 feet. Once the monuments 12 have been laid out, step 2 determines the location of the monument 12 at the highest elevation. In FIG. 1A, monument 12*c* lies on the point of highest elevation within its parking lot 18, whereas in FIG. 1B, monument 12*a* is on the point of highest elevation. Next in the third step as shown in FIG. 1A, the foundation 22*c* for the monument 12*c* is constructed at the point of highest elevation. In step 4, the next foundation 22*e* is built of a height that will maintain the cable segments 20'"*a* and '"*b* horizontally oriented. As shown in FIG. 1A, the vertical height of the foundation 22*e* must be made taller than that of the first foundation 22*c*. The required height is determined by the use of a laser level, which is laid on the top surface of the foundation 22*c* and projects with a high degree of accuracy a horizontal beam toward the position where the second foundation 22*e* will be placed. In particular, the bottom end of a rigid ruler is placed at the point where the second foundation will be constructed so as to intercept the laser beam. The height of the point where the laser beam intercepts the ruler, as measured by the ruler, determines the vertical height of the second foundation. 12*e*. Step 4 is repeated until the heights of the foundations 22*b*–22*a* are measured and these foundations constructed.

Figure 5B:
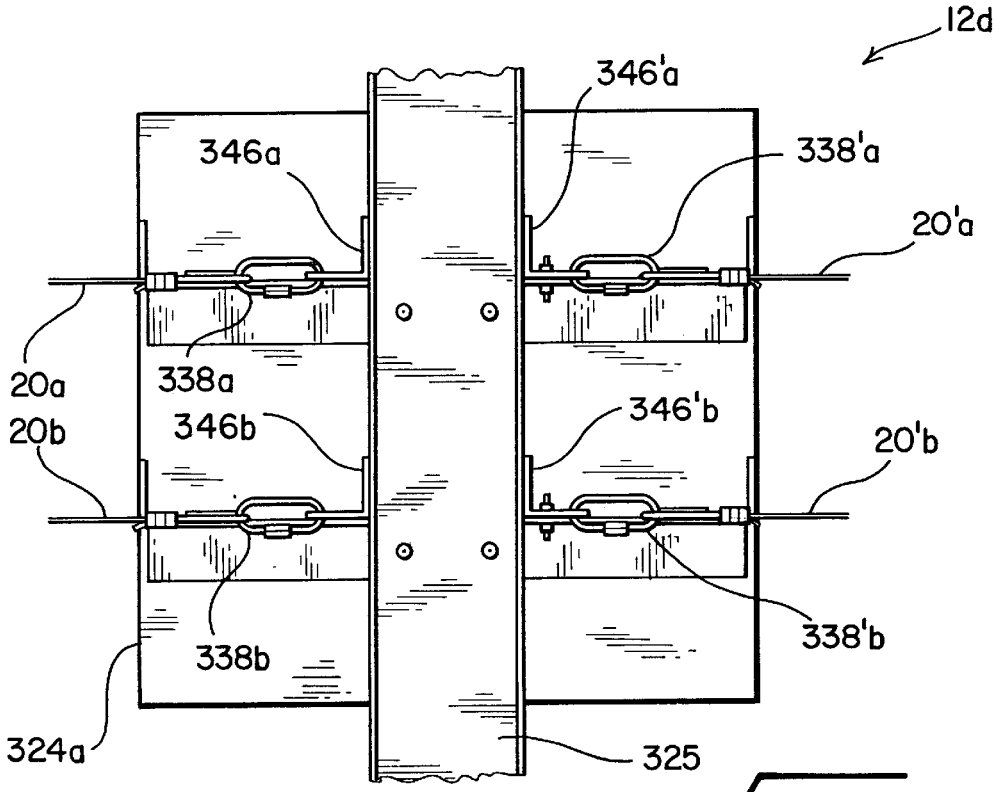

After all of the foundations 22 are so constructed, then the support tubes 25 are mounted on their respective foundations 22. The height at which the tubes 25 support the cables or cable segments 22 above the bottom of the post 25 is the same in this illustrative embodiment, regardless of the structure of that particular monument 12. In particular, the rollers 30 and 130 of the monuments 12*a* (FIG. 2B) and *b* (FIG. 3B), as well as the brackets 246*a* and 346*a* of monuments 12*e* (FIG. 4B) and 12*d* (FIG. 5B) are so configured and attached to their support tubes 25 so as to suspend their cables 20 at the same height from the bottom ends of these tubes 25. In this fashion, the cables 20 are suspended horizontally and the signs at a height greater than a minimum height, e.g., the 6 foot, 8 inches standard set by the ADA.

Figure 1B:
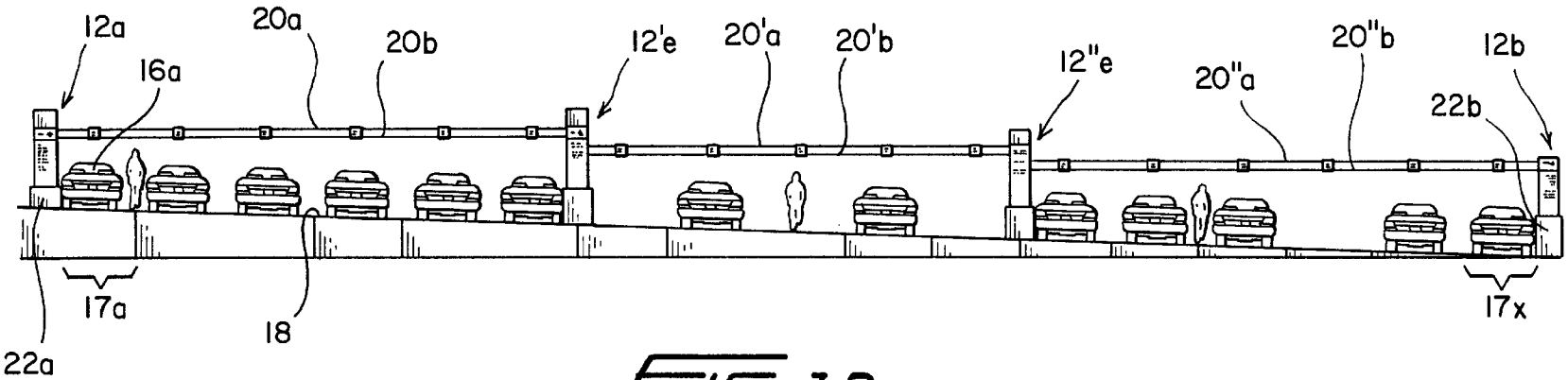
Figure 2C:
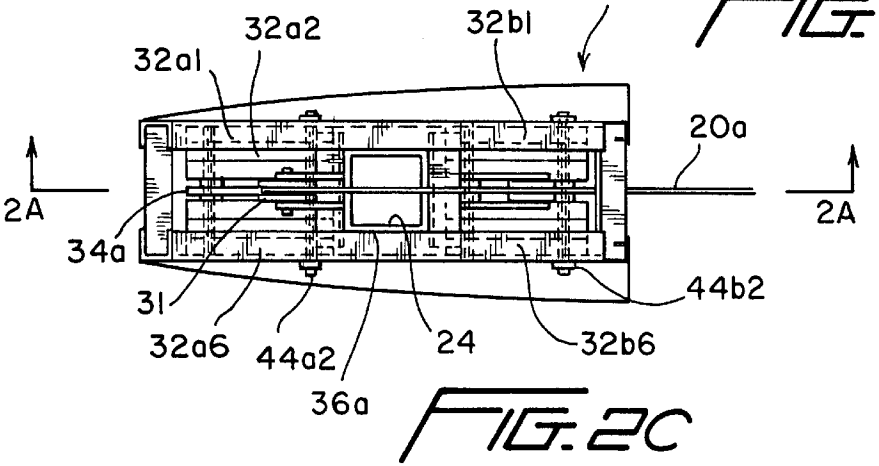

In a further illustrative embodiment of this invention as shown in FIG. 1B, the slope of the parking lot 18 is too steep to compensate for the height discrepancy of the monuments 12 by only constructing the foundations 22 of different vertical heights. To at least cable segments 20'*a* and *b*' is set lower than the height of the first set of cables 20*a* and *b*, compensate in part for the steep slope of the parking lot 18, the height of the second set of while the height of the third set of cable segments 20'"*a* and '"*b* is set lower than the second set of cables 20'*a* and '*b*. These height adjustments are made by the monuments 12'*e* and 12"*e*, which resemble in part the structure of the monument 12*e*, which is shown in FIGS. 4A and B. The difference between the monuments 12*e* and 12'*e* resides in the difference in the heights at which the first set of L-shaped brackets 246'*a* and '*b* and the second set of L-shaped brackets 246*a* and *b* are attached to the support post 225. In particular, the first set of L-shaped brackets 246'*a* and '*b* are set lower on the post 25 than the second set of L-shaped brackets 246*a* and *b*. As a result, the first set of cable segments 20'*a* and '*b*, which are connected respectively to the first set of L-shaped brackets 246'*a* and '*b*, are disposed at a lower height than the second set of cable segments 20*a* and *b*, which are connected respectively to the second set of L-shaped brackets 246*a* and *b*.

As the description of the preferred embodiments illustrates, the above described suspension of a plurality of signs presents a new useful, and nonobvious method and apparatus which is an improvement over the prior art method and apparatus. As will be apparent to those skilled in the art, there are numerous modifications, substitutions, and equivalents to elements of the invention which do not materially deviate from the spirit and scope of the invention. Accordingly, it is expressly intended that all such modifications, variations, substitutions, and equivalents for the various elements of the invention which fall with the spirit an scope of the invention be included, as recited by the following claims.

We claim:

1. A sign system adapted for use with a parking lot, the parking lot including a plurality of parking spaces, said sign system comprising:

(a) at least first and second monuments;

(b) a plurality of signs, each being disposed adjacent to and bearing indicia identifying a corresponding one of the plurality of parking spaces;

(c) at least first and second cable segments suspended between said first and second monuments in a spaced relationship to each other, each of said plurality of signs being affixed to both of said first and second cable segments in a steadying relationship; and (d) said first monument includes first and second weights, each of said first and second weights coupled respectively to a corresponding one of said first and second cable segments, whereby tension is applied to each of said first and second cable segments.

2. The sign system as claimed in claim 1, wherein said second monument includes a third weight that is coupled to at least one of said first and second cable segments.

3. The sign system as claimed in claim 1, wherein there is included third and fourth cable segments, and a third monument spaced from said second monument for suspending said third and fourth cable segments between said second and third monuments.

4. The sign system as claimed in claim 3, wherein said third monument includes third and fourth weights, each of said third and fourth weights coupled respectively to a corresponding one of said third and fourth cable segments, whereby tension is applied to each of said first and second cable segments.

5. The sign system as claimed in claim 4, wherein said second monument includes a fifth weight that is coupled to at least one of said first and second cable segments, and a sixth weight that is coupled to at least one of said third and fourth cable segments.

6. The sign system as claimed in claim 1, wherein each of said first and second cable segments includes first and second ends, said first ends being connected respectively to said first and second weights and said second ends being affixed to said second monument.

7. The sign system as claimed in claim 6, wherein there is included third and fourth cable segments, and a third monument, said third and fourth cable segments suspended between said second and third monuments.

8. The sign system as claimed in claim 7, wherein said third and fourth cable segments are affixed to said second monument.

9. A sign system for use with an area divided into a plurality of spaces, said sign system comprising:

(a) at least first and second monuments:

(b) a plurality of signs bearing indicia identifying a corresponding one of the plurality of spaces:

(c) at least one cable segment suspended between said first and second monuments and affixed to each of said plurality of signs, whereby each of said plurality of signs is disposed adjacent to and bearing indicia identifying a corresponding one of the plurality of spaces; and (d) at least one of said first and second monuments including a first weight affixed to said cable segment, whereby tension is applied to said cable segment.

10. The sign system as claimed in claim 9, wherein there is further included a second cable segment suspended between said first and second monuments and affixed to each of said plurality of said signs, whereby the stability of the plurality of signs is enhanced.

11. The sign system as claimed in claim 9, wherein said cable segment has first and second ends and there is further included a second weight, said first end coupled to said first weight and said second end coupled to said second weight.

12. A wind resistant sign system comprising:

(a) at least one cable segment suspended under tension along a first axis; and (b) a sign suspended from said one cable segment, said sign having first and second edges oriented substantially perpendicular to said axis and being configured such that the wind primarily spills around said first and second edges, whereby the wind tends to rotate said sign about said axis and said at least one cable segment tends to constrain such rotational motion.

13. The wind resistant sign system as claimed in claim 12, wherein said sign comprises at least first and second opposing surfaces and there is included a second axis oriented substantially perpendicular to said first axis, at least one of said first and second surfaces being curved about said second axis to impart a first curvature to said one surface.

14. The wind resistant sign system as claimed in claim 13, wherein the other of said first and second surfaces is curved about said second axis to impart a second curvature to said other surface, whereby said first curvature is concave with respect to said second curvature.

15. The wind resistant sign system as claimed in claim 12, wherein there is included another cable segment that is disposed substantially parallel to said at least one cable segment, and said sign is suspended from said other cable segment.

16. The wind resistant sign system as claimed in claim 12, wherein there is further included at least one weight affixed to said at least one cable segment, whereby tension is applied to said cable segment.

17. A sign system adapted for use with a parking lot, the parking lot including a plurality of parking spaces, said sign system comprising:

(a) at least first and second monuments;

(b) a plurality of signs, each being disposed adjacent to and bearing indicia identifying a corresponding one of the plurality of parking spaces;

(c) at least first and second cable segments suspended between said first and second monuments in a spaced relationship to each other, each of said plurality of signs being affixed to both of said first and second cable segments in a steadying relationship;

(d) said first monument includes first and second weights each of said first and second weights coupled respectively to a corresponding one of said first and second cable segments, whereby tension is applied to each of said first and second cable segments; and (e) said second monument includes a third weight that is coupled to at least one of said first and second cable segments, said first and second cable segments are connected together to form a single composite cable, and said third weight being coupled to said composite cable whereby tensions is applied by said third weight to each of said first and second cable segments.

18. The sign system as claimed in claim 17, wherein there is included first, second and third grooved rollers, said composite cable extending from said first monument to and suspended over said first roller, extending downward and suspending said second roller and extending upward and over said third roller.

19. The sign system as claimed in claim 18, wherein there is included a first fixedly mounted arm for rotatively mounting said first roller, and a second fixedly mounted arm for rotatively mounting said third roller.

20. The sign system as claimed in claim 19, wherein there is included a third arm for rotatively mounting said second roller and connected to said third weight, said second roller suspended by said composite cable to move as said composite cable is stretched to place tension on said composite cable.

21. A sign system adapted for use with a parking lot, the parking lot including a plurality of parking spaces, said sign system comprising:

(a) at least first and second monuments;

(b) a plurality of signs, each being disposed adjacent to and bearing indicia identifying a corresponding one of the plurality of parking spaces;

(c) at least first and second cable segments suspended between said first and second monuments in a spaced relationship to each other, each of said plurality of signs being affixed to both of said first and second cable segments in a steadying relationship;

(d) said first monument includes first and second weights each of said first and second weights coupled respectively to a corresponding one of said first and second cable segments, whereby tension is applied to each of said first and second cable segments;

(e) third and fourth cable segments;

(f) a third monument spaced from said second monument for suspending said third and fourth cable segments between said second and third monuments, said third monument includes third and fourth weights, each of said third and fourth weights coupled respectively to a corresponding one of said third and fourth cable segments, whereby tension is applied to each of first and second cable segments;

(g) fifth and sixth weights, said second monument includes said fifth weight that is coupled to at least one of said first and second cable segments, and said sixth weight that is coupled to at least one of said third and fourth cable segments; and (h) said first and second cable segments are connected together to form a first single composite cable, said third and fourth cable segments are connected together to form a second composite cable, said fifth weight is coupled to said first composite cable, and said sixth weight is coupled to said second composite cable.

22. A sign system as claimed in claim 21, wherein said second monument includes first, second, third, fourth, fifth and sixth grooved rollers, said first composite cable extending from said first monument to and suspended over said first roller, extending downward and suspending said second roller and extending upward an over said third roller, and said second composite cable extending from said third monument to and suspended over said fourth roller, extending downward and suspending said fifth roller and extending upward and over said sixth roller.

23. A sign system as claimed in claim 22, wherein there is further included a first fixedly mounted arm for rotatively mounting said first roller, a third fixedly mounted arm for rotatively mounting said third roller, a fourth fixedly mounted arm for rotatively mounting said fourth roller, a sixth fixedly mounted arm for rotatively mounting said sixth roller, a second arm for rotatively mounting said second roller and connected to said fifth weight, and a fifth arm for rotatively mounting said fifth roller and connected to said sixth weight.

24. The sign system as claimed in claim 23, wherein there is included a guide affixed to each of said second and fifth arms so that said second and fifth rollers move in unison with each other.

25. The sign system as claimed in claim 24, wherein said second monument includes a support tube, and said guide engages said support tube to guide the travel of said fifth and sixth weights along said support tube.

* * * * *

UNITED STATES PATENT AND TRADEMARK OFFICE

CERTIFICATE OF CORRECTION

PATENT NO. : 6,823,619 B2 
DATED : November 30, 2004
INVENTOR(S) : Kurt Monigle, Charles A. Hahn and Thomas Wilson It is certified that error appears in the above-identified patent and that said Letters Patent is hereby corrected as shown below:

Column 1,
Line 45, "its parking place" should read -- their parking place --
Line 62, "For example where" should read -- For example, where --

Column 9,
Line 33, "that that this" should read -- that this --

Column 14,
Line 43, "upward an over" should read -- upward and over --

Signed and Sealed this

Thirty-first Day of May, 2005

JON W. DUDAS
*Director of the United States Patent and Trademark Office*